United States Patent [19]

Carlson

[11] 4,201,521

[45] May 6, 1980

[54] PUMP AND MOTOR ASSEMBLY

[75] Inventor: Robert E. Carlson, Livonia, Mich.

[73] Assignee: TRW Inc., Cleveland, Ohio

[21] Appl. No.: 888,248

[22] Filed: Mar. 20, 1978

[51] Int. Cl.[2] ..... F04B 35/04

[52] U.S. Cl. ..... 417/53; 29/156.4 R; 29/464; 417/410; 418/131; 418/135

[58] Field of Search ..... 417/410, 53; 418/131, 418/133, 135, 70; 29/464, 156.4 R

[56] References Cited

U.S. PATENT DOCUMENTS

| | | | |
|---|---|---|---|
| 2,885,962 | 5/1959 | Campbell | 418/135 X |
| 3,200,752 | 8/1965 | Clark et al. | 418/135 X |
| 3,639,085 | 2/1972 | Bertach et al. | 417/410 |
| 3,787,151 | 1/1974 | Carlson | 418/133 |
| 3,797,977 | 3/1974 | Carlson | 418/267 |

FOREIGN PATENT DOCUMENTS

| | | | |
|---|---|---|---|
| 962131 | 2/1975 | Canada | 418/133 |
| 2423773 | 11/1975 | Fed. Rep. of Germany . | |
| 1397598 | 6/1975 | United Kingdom . | |
| 1414172 | 11/1975 | United Kingdom . | |

*Primary Examiner*—Carlton R. Croyle
*Assistant Examiner*—Edward Look

[57] ABSTRACT

An improved pump and motor assembly includes a fluid pump and an electric motor which are accurately positioned relative to each other by a plurality of locating pins which engage the inner surface of a common housing. By using a single reference surface, that is the inside surface of the housing, the adding of tolerances and the resulting compounding of inaccuracies in locating the pump and motor relative to each other is avoided. The pump has a cheek plate with a bearing surface which rotatably supports one end of the motor armature shaft. The locating pins extend outwardly from a major side surface of the cheek plate into abutting engagement with the inner surface of the housing to locate the cheek plate and the armature shaft bearing surface relative to the housing. A cam or stator ring of the pump is also mounted on the locating pins to accurately position the cam ring relative to the pump rotor and motor armature.

42 Claims, 4 Drawing Figures

PUMP AND MOTOR ASSEMBLY

BACKGROUND OF THE INVENTION

This invention relates generally to a pump and motor assembly and more specifically to the manner in which a motor armature is accurately aligned with a cam or stator ring of a pump.

A known pump and motor assembly is disclosed in U.S. patent application Ser. No. 748,061 filed Dec. 6, 1976 by Drutchas et al. and entitled "Pump and Motor Assembly". The pump and motor assembly disclosed in this application includes an electric motor having an armature shaft. One end of the armature shaft is rotatably supported by a bearing which is mounted in a dividing wall between pump and motor sections of a common housing. A cheek plate of the pump unit is supported in coaxial relationship with the motor armature by mounting the cheek plate on the same bearing as is utilized to support the motor armature shaft. An anchor pin engages the dividing wall to hold the cheek plate against the rotation. Dowel pins which are separate from the anchor pin, extend outwardly from the opposite side of the inner cheek plate to support the cam ring of the pump unit. Problems may be encountered with this construction due to a build-up of tolerances between the various reference surfaces for positioning the motor armature shaft and pump cam ring.

SUMMARY OF THE PRESENT INVENTION

The present invention provides a new and improved pump and motor assembly in which the problem of build-up of tolerances between locating surfaces for various components of a pump and motor are eliminated. This is accomplished by using a single reference surface to locate both the motor armature and the pump cam ring.

The pump and motor assembly includes a housing having an inner surface which defines a chamber in which the pump and motor are located. A plurality of locating pins extend outwardly from opposite sides of a cheek plate of the pump. The locating pins engage the inner surface of the housing to accurately locate a bearing surface on the cheek plate relative to the central axis of the housing. This bearing surface is used to rotatably support an end of the motor armature shaft to which a rotor of the pump is connected.

The opposite end portions of the locating pins engage the cam ring or stator of the pump to accurately position the cam ring relative to the motor armature shaft and the rotor of the pump. Since the inner surface of the housing is utilized to accurately position the motor armature shaft, the pump rotor and the pump cam ring relative to each other, the pump and motor assembly is readily assembled without inaccuracies resulting from a build-up of tolerances between various locating surfaces.

Accordingly, it is an object of this invention to provide a new and improved pump and motor assembly in which a build-up of tolerances between various components of the pump and motor assembly is prevented by using the same reference surface to accurately locate components of the pump relative to components of the motor.

Another object of this invention is to provide a new and improved pump and motor assembly in which locating elements extend between a cheek plate of the pump and an inner surface of a housing to locate an armature shaft bearing surface on the cheek plate of the pump in a coaxial relationship with a stator ring of the pump.

Another object of this invention is to provide a new and improved pump and motor assembly wherein a plurality of pins extend outwardly from opposite sides of a support plate and engage a housing to locate a motor armature bearing surface on the support plate relative to the housing and to locate a pump cam ring relative to the motor armature.

Another object of this invention is to provide a new and improved method of assembling a pump and motor in a common housing and wherein the method includes engaging the housing with a plurality of locating elements to accurately position a motor armature bearing surface and a pump cam ring relative to each other.

BRIEF DESCRIPTION OF THE DRAWINGS

The foregoing and other objects and features of the present invention will become more apparent upon a consideration of the following description taken in connection with the accompanying drawings wherein.

DESCRIPTION OF SPECIFIC PREFERRED EMBODIMENTS OF THE INVENTION

Figure 1:
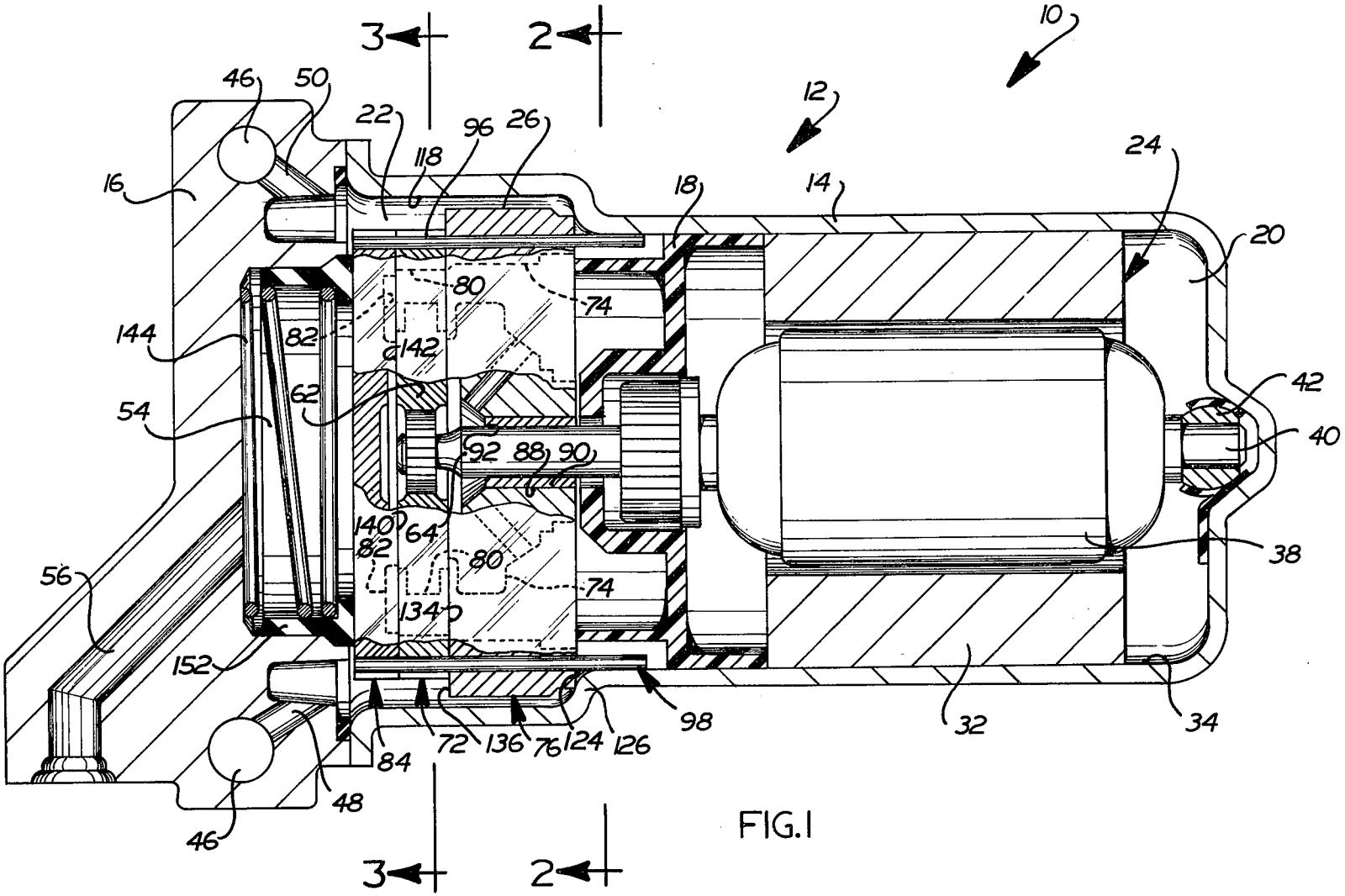
FIG. 1 is a sectional view of a pump and motor assembly constructed in accordance with the present invention.

A pump and motor assembly 10 is illustrated in FIG. 1 and includes a housing 12 having a casing or main wall 14 which is stamped as one piece from sheet metal. A circular end wall 16 is fixedly connected to the casing 14. The casing 14 has a circular dividing wall 18 which separates a cylindrical motor chamber 20 from a cylindrical pump chamber 22. An electrical motor 24 is disposed in the motor chamber 20 in a coaxial relationship with a pump 26 disposed in the pump chamber 22.

The motor 24 is energized from a suitable source of electrical energy to drive the pump 26. The motor 24 includes a cylindrical stator 32 which is fixedly connected with a cylindrical inner surface 34 of the casing 14. The stator 32 circumscribes a motor armature 38 having a shaft 40 which is supported at one end by a bearing 42. The opposite end of the motor armature shaft 40 extends through the plastic dividing wall 18 and rotates about the central axis of the motor stator 32 and housing 12 to drive the pump 26 when the motor 24 is energized.

During operation of the pump 26, fluid is conducted from an annular inlet passage 46 formed in the cast metal end wall 16 of the housing 12 to the cylindrical pump chamber 22 through passages 48 and 50. At the same time, fluid under pressure is discharged from the pump to a cylindrical outlet cavity 54 which is connected with an outlet passage 56. Although the pump and motor assembly 12 can be utilized in many different environments, it is contemplated that it will advantageously be utilized in association with a vehicle fuel supply system in the manner disclosed in the aforementioned Drutchas et al application Ser. No. 748,061 filed Dec. 6, 1976.

The pump 26 is of the well known slipper type and includes a rotor 62 (see FIGS. 1 and 3) which is mounted on an end portion 64 of the armature shaft 40. When the rotor 62 is rotated by the motor armature shaft 40, slippers 66 (FIG. 3) mounted in notches on the rotor 62 are moved through a pair of pumping chambers 68 and 70 formed between the rotor 62 and a cam ring 72. As the slippers move around the inner surface of the cam ring 72, the size of pockets or working chambers formed between the slippers 66 are varied to pump fluid in a well known manner.

Fluid from the chamber 22 is directed into the pumping chambers 68 and 70 through inlet passages 74 (see FIG. 1) formed in an inner cheek plate or end portion 76. The circular inner cheek plate 76 is disposed between the cam ring 72 and the dividing wall 18 which separates the pump chamber 22 from the motor chamber 20. The inlet passages 74 in the inner cheek plate 76 cooperate with surfaces 80 formed in the cam ring 72 and surfaces 82 formed in an outer cheek plate 84 to direct fluid into the pumping chambers 68 and 70 in the manner disclosed in the aforementioned Drutchas et al. application Ser. No. 748,061. Suitable outlet passages (not shown) are formed in the circular outer cheek plate 84 to conduct fluid from the pumping chambers 68 and 70 to the outlet chamber 54.

In addition to the inlet passages 74, the inner cheek plate 76 has a central opening 88 in which a cylindrical bearing sleeve 90 is disposed. The bearing sleeve 90 has a cylindrical bearing surface 92. The bearing surface 92 engages the cylindrical outer surface of the armature shaft 40 to rotatably support the end portion 64 of the armature shaft.

Figure 2:
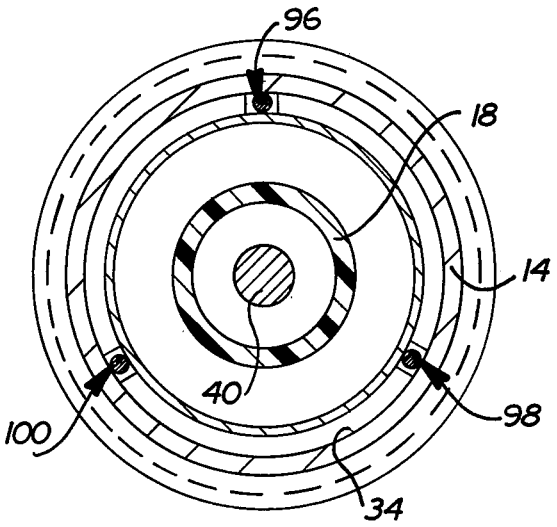
FIG. 2 is a sectional view, taken on a reduced scale along the line 2—2 of FIG. 1, and illustrating the relationship between the inner surface of a motor housing, a plurality of locating pins, and a motor armature shaft.
Figure 3:
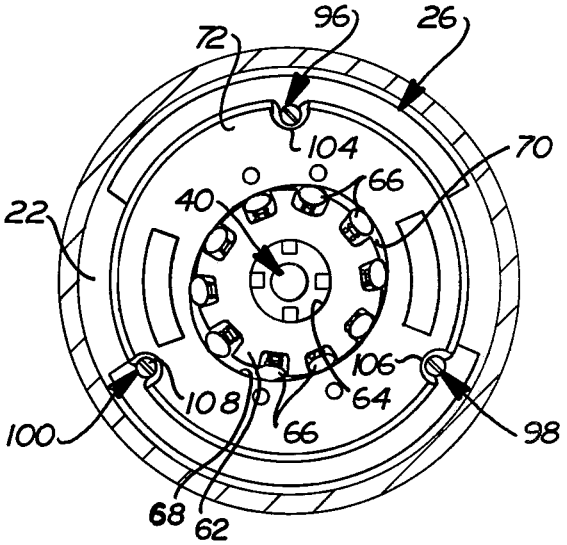
FIG. 3 is a sectional view, taken along the line 3—3 and on the same scale as FIG. 2, illustrating the relationship between the housing, locating pins, and a pump cam ring and rotor.

In accordance with a feature of the present invention, the motor 24 and pump 26 are located in a coaxial relationship with each other and with the housing 12 by a plurality of locating pins or dowels 96, 98 and 100 (see FIGS. 1, 2 and 3). The parallel locating pins 96, 98 and 100 extend rightwardly (as viewed in FIG. 1) from the pump cheek plate 76 into engagement with the cylindrical inner surface 34 of the casing 14 to locate the armature shaft bearing surface 92 in a coaxial relationship with the cylindrical motor section 20 of the casing 14 (see FIG. 2). The pins 96, 98 and 100 support the cheek plate 76 (FIG. 1) in this position to maintain the central axis about which the motor armature 40 rotates coincident with the central axis of the housing 12 and motor stator 24.

In addition, the locating pins 96, 98 and 100 are used to support the cam ring 72 in a coaxial relationship with the motor armature shaft 40 and housing 12. Thus, the parallel locating pins 96, 98 and 100 extend leftwardly (as viewed in FIG. 1) from the cheek plate 76 into engagement with a plurality of generally U-shaped recesses 104, 106 and 108 (see FIG. 3) formed in the outside of the cam ring 72. The dowel pins also extend leftwardly (as viewed in FIG. 1) from the cheek plate 76 for a distance sufficient to enable the outer cheek plate or pressure plate 84 of the pump 26 to be mounted on the dowel pins in a coaxial relationship with the inner cheek plate 76 and cam ring 72.

Inaccuracies in aligning the components of the pump 26 and motor 24 are avoided by using a single reference surface. Thus, the locating pins 96, 98 and 100 use a single reference surface, that is the inside surface 34 of the casing 14, to position and support the pump 26 in a coaxial relationship with the housing 12. This same reference surface is also used to locate and support the bearing surface 92.

Figure 4:
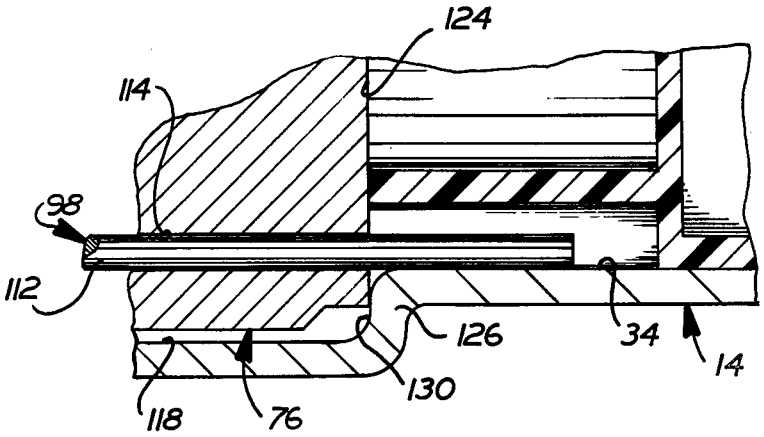
FIG. 4 is an enlarged fragmentary sectional view of a portion of FIG. 1 and illustrating how one of the locating pins engages an inner surface of the housing.

The locating pins 96, 98 and 100 are of the same construction. Thus, the locating pin 98 (see FIG. 4) has a cylindrical outer surface 112 which has an interference fit with a cylindrical passage 114 extending through the cheek plate 76 to hold the dowel pin 98 against axial movement relative to the cheek plate. The cylindrical outer surface of the dowel pin 98 also has an interference fit with the cylindrical inner surface 34 of the casing 14. The other two locating pins 96 and 100 also have interference fits with the cheek plate 76 and the casing 14. Due to the three point contact of the parallel locating pins 96, 98 and 100 with the cylindrical inner surface 34 of the casing at a location which is axially offset from the cheek plate 76, the cylindrical bearing surface 92 is accurately aligned with the central axis of the casing 14 and the motor 24.

The locating pins 96, 98 and 100 support the pump 26 in the pump chamber 22 with the outer side surface of the pump spaced from the cylindrical portion 118 of the inner surface 34 of the casing. This spacing enables fluid conducted from the inlet 96 to flow around the pump 26 and into the fluid inlet passages 74 in the manner described in the aforementioned Drutchas et al application Ser. No. 748,061.

To promote accurate positioning of the cam ring 72 relative to the central axis of the bearing surface 92, the locating pins 96, 98 and 100 have an interference fit with the recesses 104, 106 and 108 on the outside of the cam ring. The locating pins 96, 98 and 100 also have a tight fit with the outside of the outer cheek plate 84. However, the fit with the outer cheek plate 84 is not as tight as the interference fit with the cam ring 72. This arrangement of the components of the pump 26 enables the locating pins 96, 98 and 100 to align the pump with the motor armature shaft 40 and to hold the components of the pump against rotation when the motor 24 is energized to rotate the pump rotor 62.

The inner cheek plate 76 of the pump 26 is located axially relative to the armature shaft 40 by engagement of an inner major side surface 124 (see FIG. 4) of the cheek plate 76 with a connector or shoulder section 126 of the casing 14. The annular shoulder section 126 has an inner surface 130 which extends radially between the relatively small diameter motor section 20 and the relatively large diameter pump section 22 of the casing 14. Therefore, the cheek plate 76 of the pump is located both radially and axially by the inner surface 34 of the motor casing 14. This is because the locating pins 96, 98 and 100 engage the inner surface 34 to position the cheek plate 76 radially and the circular major side surface 124 of the cheek plate engages the radially extending area 130 of the inner surface 34 to position the cheek plate axially.

The cam ring 72 has a circular inner major side surface 134 which is disposed in abutting engagement with a circular outer major side surface 136 of the cheek plate 76 to locate the cam ring axially in the pump chamber 22. The end plate or pressure plate 84 has a circular inner major side surface 140 which is pressed against the outer major side surface 142 of the cam ring 72 by a spring 144. During operation of the pump and motor assembly 10, fluid pressure in the outlet chamber 54 assists the spring 44 in pressing the entire stack up of pump parts axially toward the right (as viewed in FIG. 1) to maintain the cheek plates 76 and 84 in tight abutting engagement with the cam ring 72 and to press the inner cheek plate 76 firmly against the shoulder section 126 of the casing 14.

When the motor 24 and pump 26 are to be assembled in the housing 12, the motor stator 32 is first fixedly connected with the inner surface 34 of the casing 14 by means of a suitable adhesive. The motor armature 38 is then located in the stator 32 with the inner end of the armature shaft 40 supported by the bearing 42. The dividing wall 18 is then positioned in the casing 14 to separate the motor chamber 20 from the pump chamber 22. The dividing wall 18 holds the motor armature brushes and has several openings through which fluid may flow back and forth between the motor chamber 20 and pump chamber 22. It should be noted that the dividing wall 18 is ineffective to support the motor armature 38. Therefore, the shaft end 64 of the motor armature is, at this time, free to move sideways relative to the casing 14. It is contemplated that a removable retainer could be used to temporarily support the motor armature shaft if desired during handling of the casing prior to installation of the pump 26.

To install the pump 26 in the casing 14, the locating pins 96, 98 and 100 are pressed into the cheek plate while the cheek plate is outside of the casing. The locating pins 96, 98, and 100 have the same length and extend inwardly for the same distance from the major inner side surface 124 of the cheek plate 76. The pump rotor 62, slippers 66 and their associated biasing springs are positioned in the cam ring 72 to form what is referred to as a cam pack. The cam pack is then positioned in abutting engagement with the outer major side surface 136 of the cheek plate 76 by pressing the cam ring axially toward the cheek plate to force the locating pins 96, 98, and 100 into the recesses 104, 106 and 108 on the outside of the cam ring. Finally, the outer cheek plate 84 is pressed into the engagement with the locating pins 96, 98 and 100 to retain the cam pack in position against the inner cheek plate 76 to thereby form the pump assembly 26.

The pump assembly 26 is then installed as a unit in the casing 14. This is done by axially aligning the inner cheek plate 76 with the outer end portion 64 of the motor armature shaft 40. The pump assembly is then moved axially into the pump cavity 22. Before the leading ends of the pins 96, 98, and 100 engage the cylindrical inner surface 34 of the casing 14, the outer end portion 64 of the armature shaft 40 moves into engagement with the cylindrical bearing surface 92.

Continued inward movement of the pump assembly 26 moves the leading ends of the locating pins 96, 98 and 100 into engagement with the inner side surface 34 of the casing at a location just inwardly of the shoulder 126. As the pump assembly 26 is pressed axially toward the shoulder 126, the locating pins 96, 98, and 100 slide along the inner surface 34 of the casing 14. The interference fit between the cylindrical outer surfaces of the locating pins 96, 98 and 100 and the cylindrical inner side surface 34 of the casing causes the locating pins to accurately locate the bearing surface 92 and the outer end portion 64 of the armature shaft 40 in a coaxial relationship with the motor stator 32.

The inward movement of the pump assembly 26 is stopped when the circular major side surface 124 of the cheek plate 76 abuts the annular shoulder 126. It should be noted that at this time the cheek plate 76 acts as a support plate for the motor armature shaft 64 and is effective to hold the motor armature shaft against sidewise movement. In addition, the locating pins and cheek plate 76 are effective to support the cam ring 72 and outer cheek plate 84. Although it is preferred to use the inner cheek plate 76 of the pump assembly 26 to support the motor armature shaft 40, it is contemplated that in certain embodiments of the invention it may be desirable to provide a support plate which is separate from the pump cheek plate.

Once the pump assembly 26 has been positioned in the pump chamber 22 in the manner previously described, the end wall 16 is bolted to the casing 14 with the spring 144 and a suitable seal 152 located in the outlet chamber 54. The pressure of the spring 144 against the seal 152 and the outer cheek plate 44 holds the components of the pump 26 in position in the chamber 22. However, if desired, suitable spring clips could engage the outer ends of the locating pins 96, 98 and 100 to hold the components of the pump relative to each other. Although it is contemplated that many different types of slipper and rotor constructions could be utilized in the pump assembly 26, it is contemplated that the pump will be utilized to handle fluids with a relatively low viscosity and therefore the slippers 66 have been provided with a continuous cam engaging surface proportioned in accordance with the teachings of U.S. Pat. No. 3,797,977.

Although the previously described sequence of assembly operations is preferred, it is contemplated that other assembly sequences could be utilized. For example, it is contemplated that the inner cheek plate 76 could be positioned in the pump chamber 22 and the cam pack, that is the cam ring 72, rotor 62, and slippers 66 and associated biasing springs, could be installed on the cheek plate 76 after the cheek plate has been positioned in the housing. In addition, it is contemplated that the outer cheek plate 84 could be inserted after the cam pack and inner cheek plate have been installed in the pump chamber 22.

In view of the foregoing description, it is apparent that the present invention provides a new and improved pump and motor assembly 10 in which the problem of build-up of tolerances between locating surfaces for various components of a pump 26 and motor 24 are eliminated. This is accomplished by using a single reference surface 34 to locate both the motor armature 38 and the pump cam ring 72.

The pump and motor assembly 10 includes a housing 12 having an inner surface 34 which defines a chamber in which the pump and motor are located. A plurality of locating pins 96, 98 and 100 extend outwardly from opposite sides of a cheek plate 76 of the pump 26. The locating pins 96, 98 and 100 engage the inner surface 34 of the housing 12 to accurately locate a bearing surface 92 on the cheek plate 76 relative to the central axis of the housing. The bearing surface 92 is used to rotatably support an end 64 of the motor armature shaft 40 to which a rotor 62 of the pump is connected.

The outer end portions of the locating pins engage the cam ring or stator 72 of the pump 26 to accurately position the cam ring 72 relative to the motor armature shaft 40 and the rotor 62 of the pump. Since the inner surface 34 of the housing is utilized to accurately position the motor armature shaft 40, the pump motor 62 and the pump cam ring 72 relative to each other, the pump and motor assembly 10 is readily assembled without inaccuracies resulting from a build-up of tolerances between various locating surfaces.

Having described one specific preferred embodiment of the invention, the following is claimed:

1. A pump and motor assembly comprising a housing having an inner surface which at least partially defines a chamber, a rotatable motor armature disposed in said chamber, a pump assembly disposed in said chamber, said pump assembly including a rotor connected with one end portion of said motor armature for rotation therewith, a stator ring circumscribing said rotor, a cheek plate cooperating with said stator ring and rotor to at least partially define a pumping chamber, bearing surface means disposed on said cheek plate for rotatably supporting said one end portion of said motor armature, and locating means extending between said cheek plate and the inner surface of said housing for positioning said cheek plate with said bearing surface means in a coaxial relationship with said motor armature and said stator ring, said locating means including a plurality of spaced apart members connected with said cheek plate and disposed in abutting engagement with the inner surface of said housing.

2. A pump and motor assembly comprising a housing having an inner surface which at least partially defines a chamber, a rotatable motor armature disposed in said chamber, a pump assembly disposed in said chamber, said pump assembly including a rotor connected with one end portion of said motor armature for rotation therewith, a stator ring circumscribing said rotor, a cheek plate cooperating with said stator ring and rotor to at least partially define a pumping chamber, said cheek plate having a first major side surface disposed in abutting engagement with said stator ring and a second major side surface disposed in abutting engagement with the inner surface of said housing, bearing surface means disposed on said cheek plate for rotatably supporting said one end portion of said motor armature, and locating means extending between said cheek plate and the inner surface of said housing for positioning said cheek plate with said bearing surface means in a coaxial relationship with said motor armature and said stator ring, said locating means extending outwardly from said second major side surface of said cheek plate into engagement with said inner surface of said housing.

3. A pump and motor assembly as set forth in claim 2 wherein said locating means extends outwardly from said first major side surface of said cheek plate into engagement with said stator ring.

4. A pump and motor assembly as set forth in claim 3 wherein said locating means includes a plurality of pins which extend through said cheek plate.

5. A pump and motor assembly comprising a housing having an inner surface which at least partially defines a chamber, a rotatable motor armature disposed in said chamber, a pump assembly disposed in said chamber, said pump assembly including a rotor connected with one end portion of said motor armature for rotation therewith, a stator ring circumscribing said rotor, a cheek plate cooperating with said stator ring and rotor to at least partially define a pumping chamber, said cheek plate having surface means for directing fluid into said pumping chamber, bearing surface means disposed on said cheek plate for rotatably supporting said one end portion of said motor armature, and locating means extending between said cheek plate and the inner surface of said housing for positioning said cheek plate with said bearing surface means in a coaxial relationship with said motor armature and said stator ring.

6. A pump and motor assembly comprising a housing having an inner surface which at least partially defines a chamber, a rotatable motor armature disposed in said chamber, a pump assembly disposed in said chamber, said pump assembly including a rotor connected with one end portion of said motor armature for rotation therewith, a stator ring circumscribing said rotor, a cheek plate cooperating with said stator ring and rotor to at least partially define a pumping chamber, bearing surface means disposed on said cheek plate for rotatably supporting said one end portion of said motor armature, and locating means extending between said cheek plate and the inner surface of said housing for positioning said cheek plate with said bearing surface means in a coaxial relationship with said motor armature and said stator ring, said locating means including a plurality of longitudinally extending members at least some of which project from said cheek plate into abutting engagement with the inner surface of said housing and at least some of which project from said cheek plate into abutting engagement with said stator ring.

7. A pump and motor assembly as set forth in claim 6 wherein said longitudinally extending members have central axes which are parallel to the axis of the rotation of said motor armature.

8. A pump and motor assembly comprising a housing having an inner surface which at least partially defines a chamber, a rotatable motor armature disposed in said chamber, a pump assembly disposed in said chamber, said pump assembly including a rotor connected with one end portion of said motor armature for rotation therewith, a stator ring circumscribing said rotor, a cheek plate cooperating with said stator ring and rotor to at least partially define a pumping chamber, bearing surface means disposed on said cheek plate for rotatably supporting said one end portion of said motor armature, and locating means extending between said cheek plate and the inner surface of said housing for positioning said cheek plate with said bearing surface means in a coaxial relationship with said motor armature and said stator ring, said locating means including a plurality of pins which extend through said cheek plate, each of said pins having a first end portion disposed in engagement with the inner surface of said housing and a second end portion disposed in engagement with said stator ring.

9. A pump and motor assembly as set forth in claim 8 wherein said pins have central axes extending parallel to the axis of rotation of said motor armature.

10. A pump and motor assembly comprising a housing having an inner surface which at least partially defines a chamber, a rotatable motor armature disposed in said chamber, a pump assembly disposed in said chamber, said pump assembly including a rotor connected with one end portion of said motor armature for rotation therewith, a stator ring circumscribing said rotor, a cheek plate cooperating with said stator ring and rotor to at least partially define a pumping chamber, bearing surface means disposed on said cheek plate for rotatably supporting said one end portion of said motor armature, and locating means extending between said cheek plate and the inner surface of said housing for positioning said cheek plate with said bearing surface means in a coaxial relationship with said motor armature and said stator ring, said locating means including a plurality of pins which extend from opposite sides of said cheek plate, said pins having first end portions which are disposed in abutting engagement with the inner surface of said housing, said pins having second end portions which are disposed in abutting engagement with said stator ring, said pump assembly further including a second cheek plate disposed in abutting engagement with said stator ring and disposed in engagement with said second end portions of said locating pins.

11. A pump and motor assembly comprising a housing defining a chamber, wall means for dividing said chamber into a pump section and a motor section, electric motor means disposed in said motor section of said chamber for providing an output force upon transmittal of electric power to said electric motor means, said electric motor means including a motor stator fixedly connected with said housing, a rotatable armature circumscribed by said motor stator and having a longitudinally extending armature shaft with a first end portion disposed in said motor section of said chamber and a second end portion disposed in said pump section of said chamber, and first bearing means disposed in said motor section of said chamber for holding said first end portion of said armature shaft against sidewise movement relative to said housing, pump means disposed in said pump section of said chamber for pumping fluid, said pump means including a cam ring, a rotor disposed within said cam ring and connected to the second end portion of said armature shaft for rotation therewith, a plurality of pumping elements connected with said rotor for rotation therewith, said pumping elements cooperating with said cam ring and rotor to at least partially define a plurality of variable volume pockets, said pump means further including an inner cheek plate disposed between said wall means and said cam ring and cooperating with said rotor, cam ring and pumping elements to further define the plurality of variable volume pockets, said inner cheek plate having surface means for directing fluid flow to said variable volume pockets during rotation of said rotor, said inner cheek plate further having bearing surface means engaging said second end portion of said armature shaft at a location between said rotor and said wall means for rotatably supporting said second end portion of said armature shaft and for holding said second end portion of said armature shaft against sidewise movement independently of said wall means, said wall means being ineffective to rotatably support said second end portion of said armature shaft and being ineffective to hold said second end portion of said armature shaft against sidewise movement.

12. A pump and motor assembly as set forth in claim 11 further including locating means extending axially outwardly from said inner cheek plate into engagement with said housing at a location which is axially offset from said inner cheek plate for positioning and supporting said inner cheek plate in a coaxial relationship with said armature shaft.

13. A pump and motor assembly as set forth in claim 11 wherein said inner cheek plate has a first major side which is disposed in abutting engagement with said cam ring, a second major side which is spaced apart from said first major side and extends generally parallel to said first major side, and a minor side interconnecting said major sides, said minor side of said inner cheek plate being spaced apart from said housing.

14. A pump and motor assembly as set forth in claim 11 further including a plurality of pins extending through said inner cheek plate, each of said pins having a first end portion extending from a first side of said inner cheek plate and a second end portion extending from a second side of said inner cheek plate, said first end portions of each of said pins being disposed in engagement with said housing to position said cheek plate relative to said housing, said second end portions of each of said pins being disposed in engagement with said cam ring to position said cam ring in a coaxial relationship with said cheek plate.

15. A pump and motor assembly as set forth in claim 14 wherein said pump means further includes an outer cheek plate disposed on a side of said rotor and cam ring opposite from said inner cheek plate, said second end portions of each of said pins being disposed in engagement with said outer cheek plate to position said outer cheek plate in a coaxial relationship with said inner cheek plate.

16. A pump and motor assembly comprising a housing which at least partially defines a chamber, said housing including a first housing section with an inner surface which at least partially defines a portion of the chamber having a first cross sectional area, a second housing section with an inner surface which at least partially defines a portion of the chamber having a second cross sectional area which is greater than the first cross sectional area, and a connector section interconnecting said first and second housing sections, pump means for pumping fluid, said pump means being disposed in said second housing section and including a rotor and a stator ring circumscribing said rotor to at least partially define a pumping chamber, motor means for rotating said rotor, said motor means including a motor stator disposed in said first housing section and a rotatable armature which is circumscribed by said motor stator, said armature having a shaft which extends from said first housing section into said second housing section and is connected with said rotor, and support means for rotatably supporting said motor armature, said support means including a support plate disposed in said second housing section, a bearing surface connected with said support plate and disposed in engagement with said armature shaft, and a plurality of support elements extending outwardly from said support plate into engagement with the inner surface of said first housing section to locate said support plate relative to said pump means and said motor means.

17. A pump and motor assembly as set forth in claim 16 wherein said support plate has a major side surface disposed in abutting engagement with said connector section of said housing, said support elements extending outwardly from said major side surface of said support plate into abutting engagement with the inner surface of said first housing section.

18. A pump and motor assembly as set forth in claim 17 wherein said support plate has a minor side surface which extends transversely to said major side surface and is spaced apart from the inner surface of said second housing section.

19. A pump and motor assembly as set forth in claim 18 wherein said support plate has a second major side surface which extends transversely to said minor side surface and is disposed in abutting engagement with said stator ring of said pump means.

20. A pump and motor assembly as set forth in claim 16 wherein said support elements are a plurality of spaced apart pins having longitudinal central axes which extend parallel to the longitudinal central axis of said armature shaft, said pins being fixedly connected with said support plate and having outer end portions disposed in abutting engagement with the inner surface of said first housing section of said housing.

21. A pump and motor assembly as set forth in claim 16 wherein said support elements are a plurality of spaced apart pins each of which extends through and projects outwardly from opposite sides of said support plate, each of said pins having a first end portion which is disposed in abutting engagement with the inner surface of said first housing section and a second end portion which engages said stator ring of said pump means to locate said stator ring relative to said armature shaft.

22. A pump and motor assembly as set forth in claim 21 wherein one of the opposite sides of the support plate from which said pins extend is disposed in abutting engagement with said connector section of said housing.

23. A method of assembling a pump and motor in a housing, said method comprising the steps of positioning the motor in the housing with an armature shaft of the motor free to move sideways relative to the housing, holding the armature shaft against sideways movement by positioning a support plate in the housing with a bearing surface on the support plate in engagement with the armature shaft, said step of positioning the support plate in the housing including the steps of engaging the housing with a plurality of locating elements which project from the support plate to locate the support plate and bearing surface relative to the housing, positioning a rotor of the pump on the armature shaft, and positioning a stator ring of the pump in a coaxial relationship with the bearing surface, said step of positioning the stator ring of the pump including the step of engaging the stator ring with the locating elements to position the stator ring relative to the bearing surface in an orientation in which the stator ring will cooperate with the rotor to at least partially define a pumping chamber.

24. A method as set forth in claim 23 wherein said step of positioning the support plate in the housing includes the step of moving the support plate along a path extending parallel to a central axis of the armature shaft and sliding the locating elements along an inner surface of the housing as the support plate is moved along the path.

25. A method as set forth in claim 24 wherein said step of positioning the support plate in the housing includes the step of stopping movement of the support plate with a first major side surface of the support plate in abutting engagement with a portion of the inner surface of the housing.

26. A method as set forth in claim 23 wherein said step of positioning the stator ring of the pump includes the step of moving the stator ring along a path extending parallel to central axes of the locating elements and sliding the stator ring along outer surfaces of the locating elements as the stator ring is moved along the path.

27. A method as set forth in claim 26 wherein said step of positioning the stator ring of the pump includes the step of stopping movement of the stator ring along the path with a side surface of the stator ring disposed in abutting engagement with a major side surface of the support plate.

28. A method as set forth in claim 23 wherein said step of positioning a rotor on the armature shaft is performed before said step of positioning a stator ring in a coaxial relationship with the bearing surface.

29. A pump and motor assembly as set forth in claim 23 wherein said step of positioning a rotor on the armature shaft is performed after said step of positioning a stator ring in a coaxial relationship with the bearing surface.

30. A method as set forth in claim 23 wherein said step of positioning a support plate in the housing is performed after the performance of said step of positioning the stator ring of the pump in a coaxial relationship with the bearing surface.

31. A pump and motor assembly comprising a housing having a wall with a first wall section which at least partially defines a motor chamber having a first cross sectional area, a second wall section which at least partially defines a pump chamber having a second cross sectional area which is greater than the first cross sectional area, and a connector wall section extending between said first and second wall sections, a rotatable motor armature disposed in said motor chamber, a pump assembly disposed in said pump chamber, said pump assembly including a rotor connected with said motor armature for rotation therewith and an end portion cooperating with said rotor to at least partially define a pumping chamber, said end portion of said pump assembly being disposed in engagement with said connector wall section to locate said pump assembly along a central axis of said housing, and locating means extending between said end portion of said pump assembly and said first wall section of said housing for positioning said pump assembly transversely to the central axis of said housing, said locating means including a plurality of spaced apart locating members connected with said end portion of said pump assembly and having side surfaces disposed in abutting engagement with said first wall section of said housing.

32. A pump and motor assembly as set forth in claim 31 wherein said pump assembly and said locating members are spaced from said second wall section.

33. A pump and motor assembly as set forth in claim 31 wherein said end portion of said pump assembly includes a cheek plate, said pump assembly further including a stator ring which circumscribes said rotor and cooperates with said cheek plate to further define the pumping chamber, said locating members being pins which extend from opposite sides of said cheek plate, said pins having first end portions with side surfaces which are disposed in abutting engagement with said first wall section of said housing, said pins having second end portions which are disposed in abutting engagement with said stator ring.

34. A pump and motor assembly as set forth in claim 33 wherein said pump assembly further includes a second cheek plate disposed in abutting engagement with said stator ring and disposed in engagement with said second end portions of said pins.

35. A pump and motor assembly as set forth in claim 31 wherein said pump assembly further includes bearing surface means disposed on said end portion for rotatably supporting one end portion of said motor armature, said connector wall section and said first wall section cooperating with said cheek plate and locating means to position said bearing surface means relative to said motor chamber.

36. A method of assembling a pump and motor in a housing, said method comprising the steps of providing a housing having a first wall section which at least partially defines a motor chamber having a first cross sectional area, a second wall section which at least partially defines a pump chamber having a second cross sectional area which is greater than the first cross sectional area, and a connector wall section which extends between the first and second wall sections, providing a cheek plate having a first major side surface which is adapted to cooperate with a stator ring to at least partially define a pumping chamber, mounting a plurality of locating pins on the cheek plate with the pins extending outwardly from a second major side surface of the cheek plate, moving the locating pins into engagement with an inner side surface of the first wall section by moving the cheek plate toward the motor chamber with the locating pins extending forwardly in the direction of movement of the cheek plate, sliding the side surfaces of the locating pins along the inner side surface of the first wall section by continuing the movement of the cheek plate toward the motor chamber, and stopping the sliding of the locating pins along the inner side surface of the first wall section when the cheek plate has moved to a predetermined position in the pump chamber.

37. A method as set forth in claim 36 wherein said step of stopping the sliding of the locating pins along the inner side surface of the first wall section includes the step of moving the cheek plate into abutting engagement with the connector wall section.

38. A method as set forth in claim 36 wherein said step of mounting a plurality of locating pins on the cheek plate includes mounting the locating pins on the cheek plate with the locating pins extending outwardly from the first major side surface of the cheek plate, said method further including the step of mounting a stator ring on the locating pins with the stator ring disposed in abutting engagement with the first major side surface of the cheek plate.

39. A method as set forth in claim 38 wherein said step of mounting a stator ring on the locating pins is performed prior to performance of said step of moving the locating pins into engagement with the inner side surface of the first wall section.

40. A method as set forth in claim 36 wherein said step of providing a cheek plate includes the step of providing a cheek plate having a bearing surface, said method further including the steps of mounting a motor armature in the motor chamber and engaging the bearing surface with one end portion of the motor armature while moving the cheek plate toward the motor chamber.

41. A method of assembling a pump and motor in a housing, said method comprising the steps of providing a housing, positioning a motor armature in the housing, assembling a pump outside of the housing with a plurality of locating pins projecting outwardly from the pump assembly, said step of assembling a pump including the step of providing a bearing surface, moving the pump assembly into the housing with the locating pins extending forwardly in the direction of movement of the pump assembly, engaging the housing with the locating pins to position the pump assembly relative to the housing, and engaging the bearing surface with an end portion of the motor armature.

42. A method as set forth in claim 41 wherein said step of engaging the bearing surface with an end portion of the armature is performed prior to engaging the housing with the locating pins.

* * * * *